US007500662B2

(12) United States Patent
Graushar

(10) Patent No.: US 7,500,662 B2
(45) Date of Patent: Mar. 10, 2009

(54) FINISHING BUFFER

(75) Inventor: William T. Graushar, Elm Grove, WI (US)

(73) Assignee: Quad/Graphics, Inc., Sussex, WI (US)

( * ) Notice: Subject to any disclaimer, the term of this patent is extended or adjusted under 35 U.S.C. 154(b) by 14 days.

(21) Appl. No.: 10/837,097

(22) Filed: Apr. 30, 2004

(65) Prior Publication Data

US 2004/0218995 A1 Nov. 4, 2004

Related U.S. Application Data

(60) Provisional application No. 60/466,821, filed on Apr. 30, 2003.

(51) Int. Cl.
*B65H 29/00* (2006.01)

(52) U.S. Cl. ..... 270/52.07; 270/52.09; 271/189

(58) Field of Classification Search ..... 271/3.01, 271/3.03, 189; 270/52.07, 52.09, 52.1
See application file for complete search history.

(56) References Cited

U.S. PATENT DOCUMENTS 4,022,455 A * 5/1977 Newsome et al. ..... 270/52.29
4,565,478 A * 1/1986 Ericsson ..... 414/792.9
4,616,815 A * 10/1986 Vijuk ..... 270/45
4,734,865 A * 3/1988 Scullion et al. ..... 700/222
4,793,251 A * 12/1988 Kuhfuss ..... 101/93.01
5,054,984 A * 10/1991 Chan et al. ..... 412/1
5,088,711 A * 2/1992 Newsome ..... 270/52.14
5,112,179 A * 5/1992 Chan et al. ..... 412/1
5,144,562 A * 9/1992 Stikkelorum et al. ..... 700/223
5,189,863 A * 3/1993 Pozzi ..... 53/411
5,280,895 A * 1/1994 Meier ..... 270/58.03
5,826,869 A * 10/1998 Nyffenegger et al. .... 270/52.02
6,015,147 A * 1/2000 Kimura et al. ..... 271/163
6,095,512 A * 8/2000 Vijuk et al. ..... 271/3.05
6,615,105 B2 * 9/2003 Masotta ..... 700/219
2003/0062293 A1 * 4/2003 Graushar et al. ..... 209/1
2006/0262335 A1 * 11/2006 Varga ..... 358/1.13

OTHER PUBLICATIONS

Sitma buffer brochure, May 2003, 3 pages.
Ferag gatherer-stitcher brochure, Sep. 2000, 3 pages.

* cited by examiner

*Primary Examiner*—Gene Crawford
*Assistant Examiner*—Leslie Nicholson, III
(74) *Attorney, Agent, or Firm*—Michael Best & Friedrich LLP

(57) ABSTRACT

A finishing line including at least one buffer operable to receive printed products and deliver the printed products to the same or different finishing line. The buffer allows the finishing process to continue operating while one section of the finishing line is being repaired.

18 Claims, 2 Drawing Sheets

FINISHING BUFFER

RELATED APPLICATIONS

This application claims priority to U.S. Provisional Patent Application No. 60/466,821, filed Apr. 30, 2003. The contents of Application No. 60/466,821 are hereby incorporated by reference.

BACKGROUND OF THE INVENTION

In a typical printed product finishing process, which can include both perfect binding and saddle stitching for example, often times when a fault happens, such as in the gatherer, binder or the trimmer, it typically takes just a few seconds to get the fault cleared and the finishing line back up and running. However, those seconds can add up to minutes which translates into lost efficiency in time and money. During the time the fault is being repaired, the entire finishing process is stopped until the fault is cleared.

BRIEF DESCRIPTION OF THE INVENTION

The invention relates to using a buffer or multiple buffers in a printed product finishing process.

The invention relates to the use of one or more buffers in a printed product finishing process. With the use of a buffer inline in the finishing process, should there be a fault, other portions of the finishing line continue to run while the fault is being repaired. Therefore, the reduction of efficiency during the fault condition is minimized. The use of one or more buffers in the finishing process enables the process to run more continuously and to run more efficiently.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
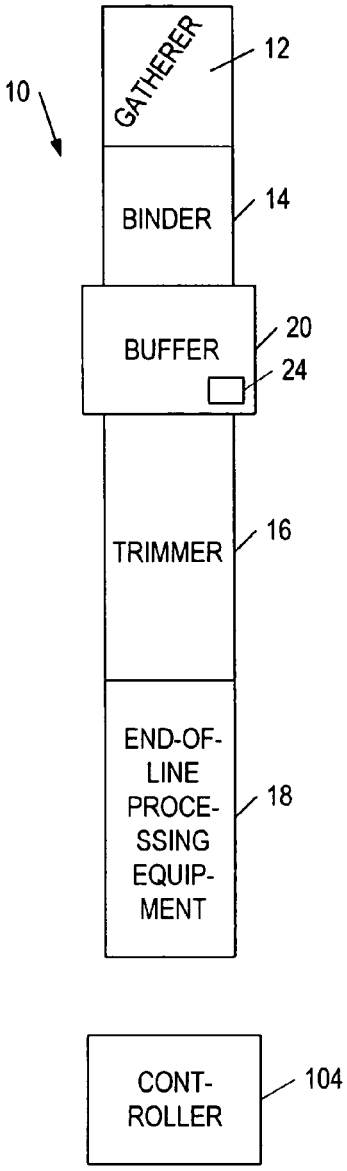
FIG. 1 is a schematic plan view of a finishing process including a buffer positioned between a binder and a trimmer.

FIG. 1 schematically illustrates a finishing line in the form of a printed product binding line 10 such as a book/magazine binding process. The printed products can be signatures, single sheets, bound books such as, magazines, catalogs, direct mail pieces, and the like. The finishing process usable with the embodiments of the present invention may include binding lines such as, either perfect binding or saddle stitching and all other types of finishing lines, such as, for example, mailing lines, wrapping lines, and packaging lines. The exemplary binding line 10 includes a gatherer 12, binder 14, trimmer 16 and end-of-line processing equipment 18. It should be noted that additional equipment may be used on the binding process as well as alternative configurations. The specifics of the equipment used and its configuration on the binding line 10 can vary while still employing the present invention.

To increase the efficiency of the binding process, at least one buffer is used. According to one embodiment of the invention, FIG. 1 illustrates a buffer 20 positioned between the binder 14 and the trimmer 16. The capacity (e.g., the number of holding slots) of the buffer can vary depending on the size of the buffer. A variety of available buffers can be utilized. For example, one buffer particularly suited for this application is model A-393 available from Sitma Corporation. However, it should be noted that other buffers can be used with the present invention.

The buffer 20, positioned between the binder 14 and the trimmer 16, enables the gatherer 12 and the binder 14 of the binding process to continue running, at least for the time it takes to fill the buffer 20, if the trimmer 16 has a fault and stops running. Conversely, if the gatherer 12 or binder 14 has a fault and ceases operating, the trimmer 16 continues running, at least until the buffer 20 is emptied.

In one embodiment of the invention, the buffer 20 can be modular or portable, meaning that it can be moved from a first location to a second location. For example, such a buffer 20 could be strategically positioned depending on the binding job. If the trimmer 16 were faulting more than the gatherer 12 or binder 14, the buffer 20 would typically be filled to its minimum capacity. Therefore, when the trimmer 16 faulted, the buffer 20 would be able to accept product from the gatherer 12 and binder 14. If the gathering or binder sections 12 and 14 were faulting more than the trimmer 16, the buffer 20 would typically be filled near its maximum capacity. Therefore, when the gatherer 12 or binder 14 faulted, the buffer 20 would be able to continue to deliver product to the trimmer 16.

Figure 2:
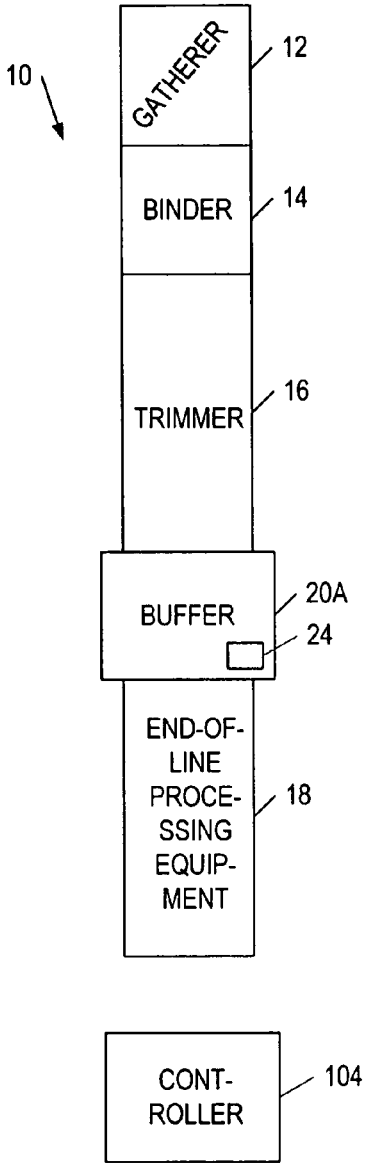
FIG. 2 is a schematic plan view of a finishing process including a buffer positioned between a trimmer and end-of-line processing equipment.

The invention contemplates other strategic locations for positioning a buffer or buffers. For example, and with reference to FIG. 2, a buffer 20A can be positioned between the trimmer 16 and the end-of-line processing equipment 18. In this arrangement, the binding process would continue despite end-of-line equipment problems such as with stackers, strappers, sorters, and the like. Other buffer positions can include a position between the gatherer 12 and the binder 14. A buffer 20 can also be located at any choke or transition point along the binding line 10. For example, the invention contemplates the use of a buffer or multiple buffers within the gatherer 12 to enable the gatherer to run when faults occur therein. The invention contemplates the use of a buffer between the gatherer 12 and binder 14 to enable that equipment to run when faults occur therein.

Figure 3:
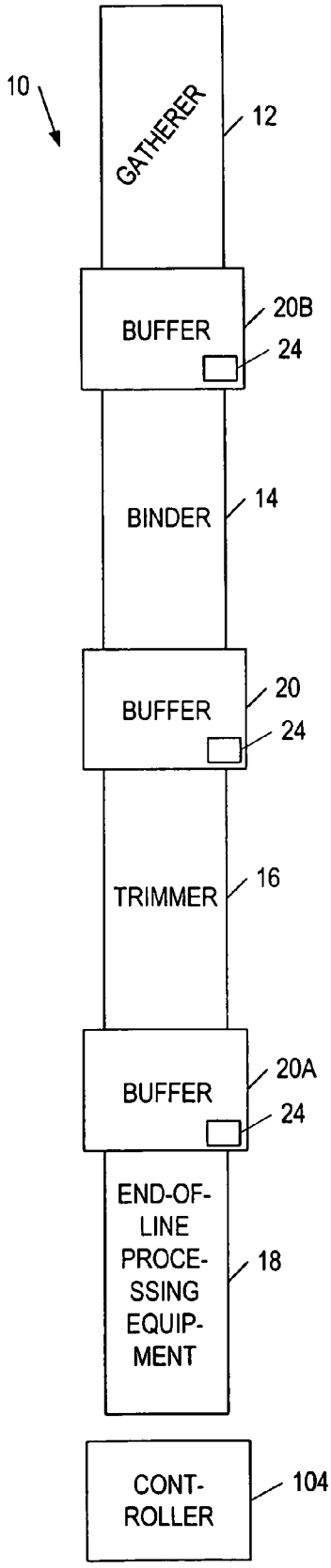
FIG. 3 is a schematic plan view of a finishing process including multiple buffers.

With reference to FIG. 3, multiple buffers 20, 20A and 20B can be used on the same binding line 10 to further increase efficiency of the binding line 10. As shown, a buffer 20B is positioned between the gatherer 12 and binder 14, a buffer 20 is positioned between the binder 14 and trimmer 16, and a buffer 20A is positioned between the trimmer 16 and end-of-line processing equipment 18. It should be noted that more or less buffers 20 could be used as well as in different positions on the binding line 10. In addition, multiple buffers can be positioned adjacent to one another to provide a larger holding capacity for the products. For example, a product can enter a first buffer, exit the first buffer, and then immediately enter a second buffer.

Figure 4:
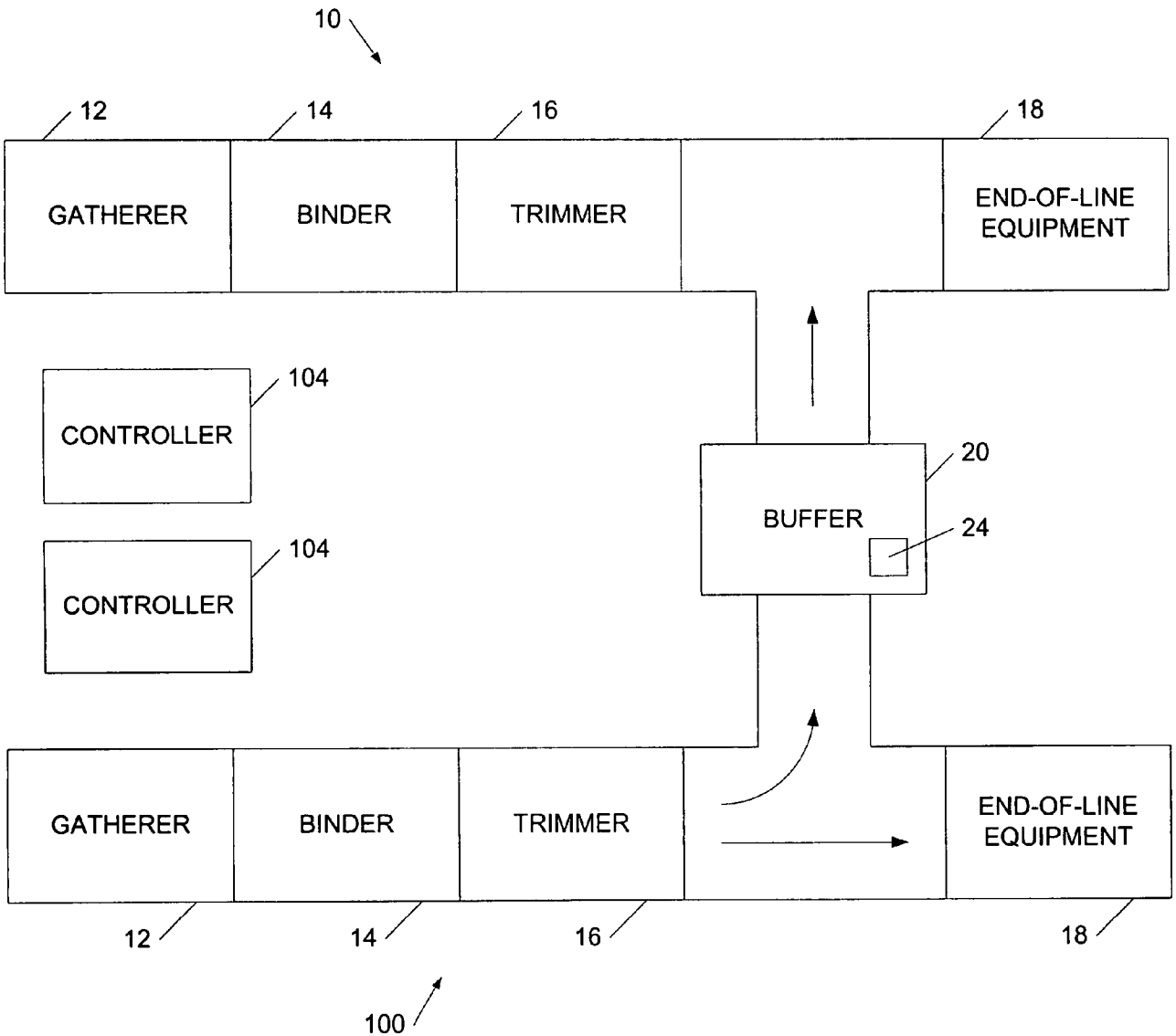
FIG. 4 is a schematic plan view of two finishing lines including a buffer positioned between the lines.

FIG. 4 illustrates a buffer 20 positioned between a first binding line 10 and a second binding line 100 according to one embodiment of the invention. The buffer 20 can be positioned at any location along the binding lines 10 and 100. In addition, the buffer 20 can be positioned at different locations on each binding line 10 and 100. For example, the buffer 20 can be positioned after the trimmer 16 on the binding line 10 and after the binder 14 on the binding line 100. The buffer 20 can receive products from the first binding line 10 and can feed the products onto the second binding line 100. Each of the binding lines 10 and 100 can include a controller 104. Each of the controllers 104 maintains a product order, mailing list, or sequence list (collectively referred to as "mailing list") for each binding line 10 and 100. One of the controllers 104 can merge the two mailing lists into one master mailing list. The products on the second binding line 100 can be positioned in a buffer 20 and be selectively fed from the buffer 20 into the proper location on the first binding line 10 according to the mailing sequence. All of the products are not required to enter the buffer 20. Rather, some of the products on the second binding line 100 can continue along the binding line 100. It should be noted that the products on each of the binding lines 10 and 100 can be of the same type, e.g., the products on the first and second binding lines 10 and 100 are magazines, for example, or different types, e.g., the products on the first binding line 10 are magazines, for example, and the products on the second binding line 100 are not magazines. It should also be noted that various classes of mail can be combined and merged into one mailing list.

To further improve the efficiency of the finishing process, various sections of the binding lines 10 and 100 can operate at different speeds from one another. In one example, the trimmer 16 and the gatherer 12 and/or binder 14 could be run at different speeds. If there are more problematic issues in the trimmer 16, the trimmer 16 would have the ability to run faster than the gatherer 12, thereby keeping the buffer 20 in a near empty state. In this way, when the trimmer 16 faults, the gatherer 12 could continue to run, putting product into the buffer 20. After the trimmer 16 fault is corrected and the buffer 20 had gained product volume, the trimmer 16 would temporarily run faster than the gatherer 12 until the buffer 20 was again near minimum capacity. Conversely, if there were more problematic issues in the gatherer 12, the opposite logic would apply. The gatherer 12 at times would run faster than the trimmer 16, keeping the buffer 20 filled near capacity so the trimmer 16 could run while faults were attended to in the gatherer 12.

The buffer 20 can include a sensor 24 as shown in FIGS. 1-4 that is operable to determine the height of the products in the buffer 20. Based on the amount of the products, the sensor 24 can communicate with the controller 104 to modify the speed of the section of the binding lines 10 and/or 100 to move faster or slower.

Various features and advantages of the invention are set forth in the following claims.

What is claimed is:

1. A method of positioning a buffer in a printed product finishing line, the method comprising:

identifying which section of a finishing line processing printed products operates with more faults;

positioning a buffer in-line, adjacent to and downstream of the identified section such that all of the printed product that passes through the identified section passes to the buffer; and continuing to process printed products on the finishing line using the buffer while one section of the finishing line is being repaired.

2. The method of claim 1, further comprising:

moving products into the buffer;

sensing an amount of the products on the buffer; and based on the amount, communicating with a controller to adjust the speed of a section of the finishing line.

3. The method of claim 1, wherein the finishing line comprises a gathering section, the method further comprising positioning the buffer downstream of the gathering section.

4. The method of claim 1, wherein the finishing line comprises a binding section, the method further comprising positioning the buffer downstream of the binding section.

5. The method of claim 1, wherein the finishing line comprises a trimming section, the method further comprising positioning the buffer downstream of the trimming section.

6. The method of claim 1, wherein the finishing line comprises a gathering section, the method further comprising positioning the buffer within the gathering section.

7. The method of claim 1, wherein the finishing line comprises a first finishing line and a second finishing line, the method further comprising positioning the buffer between the first finishing line and the second finishing line.

8. The method of claim 1, wherein the finishing line is a printed product binding line.

9. The method of claim 8, wherein the printed product binding line is a perfect binding line.

10. The method of claim 8, wherein the printed product binding line is a saddle stitching binding line.

11. The method of claim 1, wherein the finishing line is a mailing line.

12. The method of claim 1, wherein the finishing line is a wrapping line.

13. The method of claim 1, wherein the finishing line is a packaging line.

14. The method of claim 1, wherein the printed product comprises a signature.

15. The method of claim 1, wherein the printed product comprises a single sheet.

16. The method of claim 1, wherein the printed product comprises a bound book.

17. The method of claim 16, wherein the bound book is a magazine.

18. The method of claim 1, wherein the bound book is a catalog.

* * * * *

UNITED STATES PATENT AND TRADEMARK OFFICE
Certificate

Patent No. 7,500,662 B2 Patented: March 10, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William T. Graushar, Elm Grove, WI (US); and John C. Geres, West Allis, WI (US).

Signed and Sealed this Second Day of February 2010.

GENE CRAWFORD
*Supervisory Patent Examiner*
Art Unit 3651